US007428891B2

(12) United States Patent
Sato et al.

(10) Patent No.: US 7,428,891 B2
(45) Date of Patent: Sep. 30, 2008

(54) OUTBOARD MOTOR EQUIPPED WITH INTERNAL COMBUSTION ENGINE WITH CARBURETOR

(75) Inventors: Kazuyoshi Sato, Wako (JP); Hiroshi Watanabe, Wako (JP); Toshiaki Ogawa, Wako (JP); Tetsu Wada, Wako (JP); Toyokazu Kawasaki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/545,780

(22) Filed: Oct. 10, 2006

(65) Prior Publication Data

US 2007/0125342 A1 Jun. 7, 2007

(30) Foreign Application Priority Data

Dec. 2, 2005 (JP) ..... 2005-349645

(51) Int. Cl.
*F02D 9/08* (2006.01)
*F02M 29/00* (2006.01)

(52) U.S. Cl. ..... 123/337; 123/590

(58) Field of Classification Search ..... 123/337, 123/306, 590, 593, 586
See application file for complete search history.

(56) References Cited

U.S. PATENT DOCUMENTS 4,158,352 A * 6/1979 Blatter ..... 123/585
6,076,499 A * 6/2000 Klumpp ..... 123/337
6,123,322 A * 9/2000 Sasaki ..... 261/64.1
6,196,187 B1 * 3/2001 Zubeck et al. ..... 123/339.1
7,104,526 B2 * 9/2006 Mavinahally ..... 261/46

FOREIGN PATENT DOCUMENTS

JP 2500711 1/1992

* cited by examiner

*Primary Examiner*—John T Kwon
(74) *Attorney, Agent, or Firm*—Carrier, Blackman & Associates, P.C.; Joseph P. Carrier; William D. Blackman

(57) ABSTRACT

An outboard motor has an internal combustion engine with a carburetor. The carburetor is designed to extend maintenance interval greatly by preventing or suppressing the deposition of solid matters in the gap between the intake passage and a butterfly-type throttle valve therein. The throttle valve is divided, by a valve axis about which the throttle valve turns, into a first valve part that turns from the downstream side to the upstream side with respect to an air intake direction when the fully closed throttle valve is opened and a second valve part that turns from the upstream side to the downstream side with respect to the air intake direction when the fully closed throttle valve is opened. The first valve part has an edge that moves to the upstream side past bypass ports when the fully closed throttle valve is opened, and the second valve part is provided with a through hole that allows air to flow therethrough at a flow rate necessary for idling when the throttle valve is fully closed.

8 Claims, 5 Drawing Sheets

OUTBOARD MOTOR EQUIPPED WITH INTERNAL COMBUSTION ENGINE WITH CARBURETOR

FIELD OF THE INVENTION

The present invention relates to an outboard motor equipped with an internal combustion engine with carburetor. More specifically, the present invention relates to the construction of the throttle valve of a carburetor incorporated into an internal combustion engine included in an outboard motor.

BACKGROUND OF THE INVENTION

A known internal combustion engine for an outboard motor disclosed in, for example, Japanese Utility Model Registration No. 2,500,711, is provided with a carburetor including a throttle body provided with an intake passage having a substantially horizontal axis, and a butterfly-type throttle valve placed in the intake passage.

Referring to FIG. 5 showing this known internal combustion engine provided with a carburetor a having a low-speed fuel system) s, intake air flows through a narrow gap f between the circumferential edge c of a throttle valve b and a side wall e defining an intake air passage d into a combustion chamber while the internal combustion engine is idling. The internal combustion engine operates at a low engine speed during idling. Therefore, valve overlap time in which both the intake valve and the exhaust valve are open is comparatively long during idling and hence, spitting, i.e., the flow of the exhaust gas into the intake passage, occurs in some cases. If the exhaust gas spat back into the intake passage contains foreign matters, such as lubricating oil and combustion products including carbon, the foreign matters deposit on the circumferential edge of the throttle valve b or on the side wall e in a solid matter when the spat back exhaust gas flows through the gap f. The deposited solid matter exerts resistance against the flow of air flowing through the gap f to reduce the flow rate of air and, consequently, the idling speed of the internal combustion engine decreases.

The outboard motor, in particular, is operated for a long time in an idling mode in which the throttle valve is fully closed or in a very-light-load operating mode in which the throttle valve is slightly opened for trolling. Since the outboard motor is operated frequently in such a light-load operating mode, the solid matter is likely to deposit in the gap f. In some cases, the deposited solid matter makes the engine speed unstable while the internal combustion engine is operating in an idling mode or a very-light-load mode. The maintenance of the internal combustion engine needs to be performed at short intervals to avoid such unstable operation of the internal combustion engine due to the deposited solid matter.

SUMMARY OF THE INVENTION

The present invention has been made in view of such problems and it is therefore an object of the present invention to provide an outboard motor provided with a carburetor designed to prevent or suppress the deposition of solid matters in a space between its throttle valve and its member defining an intake passage and capable of greatly extending maintenance interval.

The present invention provides an outboard motor comprising an internal combustion engine with a carburetor having an intake passage, a butterfly-type throttle valve placed in the intake passage and a low-speed system having bypass ports opening into the intake passage, the butterfly-type throttle valve having a first valve part that turns from a downstream side to an upstream side with respect to an air intake direction in the intake passage when the throttle valve is opened from a fully closed position, and a second valve part that turns from the upstream side to the downstream side with respect to the air intake direction when the throttle valve is opened from the fully closed position; wherein the first valve part of the throttle valve has an edge that moves from the downstream side to the upstream side past the bypass ports when the throttle valve is opened from the fully closed position, and the second valve part of the throttle valve is provided with a through hole that allows air to flow therethrough at a flow rate necessary for idling when the throttle valve is at the fully closed position.

If the exhaust gas is spat back, the spat back exhaust gas containing foreign matters including lubricating oil and combustion products flows through the through hole of the second valve part of the throttle valve. Therefore, the deposition of solid matters in a gap between a side wall defining the intake passage and the throttle valve can be prevented or suppressed. The through hole is formed in the second valve part opposite the first valve part of the throttle valve with respect to a valve axis about which the throttle valve turns and is remote from the bypass ports. Therefore, negative pressure will not directly act through the through hole on the bypass ports and hence fuel discharge through the bypass ports is affected scarcely by the through hole.

Since fuel discharge through the bypass ports is affected scarcely by the through hole, an unstable idling operation due to the effect of the through hole can be avoided. Since the deposition of solid matters in the gap between the side wall defining the intake passage and the throttle valve can be effectively prevented or suppressed, an idle operation and a very-light-load operation can be stabilized and maintenance interval can be greatly extended.

In the outboard motor comprising an internal combustion engine with a carburetor, the intake passage of the carburetor extends substantially horizontally and the through hole is formed in a part of the throttle valve adjacent to the lowest part of the throttle valve at the fully closed position.

Since the through hole is formed adjacent to the lower end, around which solid matters are likely to be deposited by the agency of gravity, of the throttle valve, the spat back exhaust gas flowing toward the lower end of the throttle valve can easily flow through the through hole. Consequently, the deposition of foreign matters in the gap between the side wall defining the intake passage and the throttle valve can be effectively prevented or suppressed.

Preferably, a valve axis about which the throttle valve turns is substantially horizontal, and the through hole lies in an imaginary plane perpendicularly bisecting the valve axis. Preferably, the through hole is a round hole.

DESCRIPTION OF THE PREFERRED EMBODIMENTS

Figure 1:
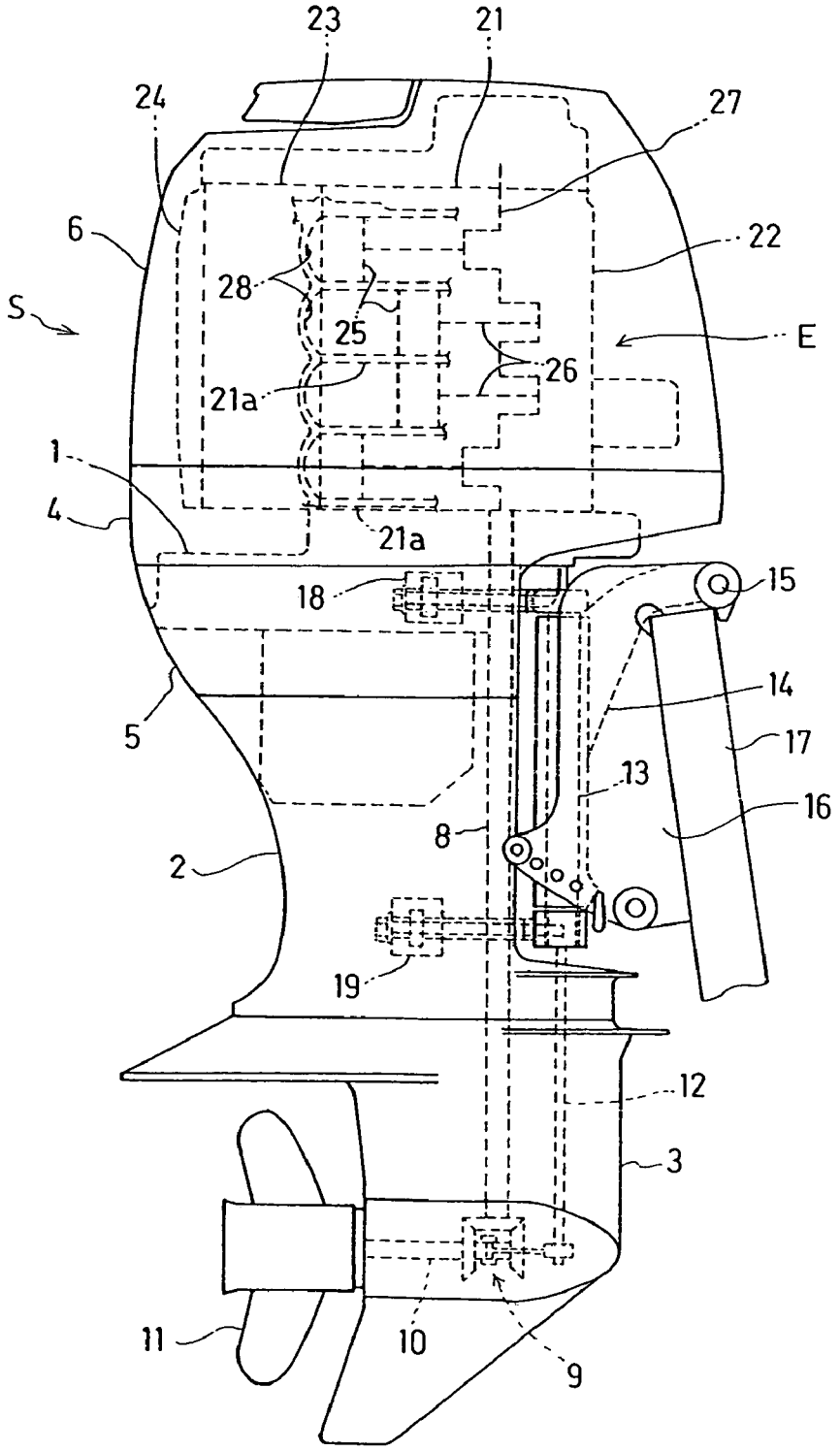
FIG. 1 is a schematic side elevation of an outboard motor in a preferred embodiment of the present invention.

Referring to FIG. 1, an outboard motor in a preferred embodiment of the present invention includes an internal combustion engine E, and an engine case. The engine case includes a mount case 1 supporting the internal combustion engine E thereon, an extension case 2 having an upper end joined to the mount case 1, a gear case 3 joined to the lower end of the extension case 2, an under case joined to the mount case 1 so as to cover a lower end part of the internal combustion engine E, an under cover 5 joined to the under case 4 so as to cover the joint of the mount case 1 and the extension case 2, and an engine cover 6 joined to the upper end of the under case 4 so as to cover the internal combustion engine E.

In the description of the embodiment, the words "vertical", "longitudinal" and "lateral" are used to qualify the status of matters related with the outboard motor S as mounted on a ship 17.

The internal combustion engine E has a crankshaft 27 disposed with its axis vertically extended. A power transmission for transmitting the power of the internal combustion engine E to a propeller 11 includes a drive shaft 8 coupled with a lower end part of the crankshaft 27, a reversing mechanism 9 contained in the gear case 3 and a propeller shaft 10 holding a propeller 11. The drive shaft 8 extends downward through the extension case 2 into the gear case 3 and is interlocked with the propeller shaft 10 by the reversing mechanism 9. The reversing mechanism 9 is operated to move the ship 17 forward or backward by turning a speed change rod 12 extended through a swivel shaft 13. The power of the internal combustion engine E is transmitted from the crankshaft 27 through the drive shaft 8, the reversing mechanism 9 and the propeller shaft 10 to the propeller 11 to drive the propeller 11 for rotation during all the operations of the internal combustion engine E including an idling operation.

A mounting device for holding the outboard motor S on the ship 17 includes the swivel shaft 13, a swivel case 14 rotatably supporting the swivel shaft 13, and a bracket 16 fixed to the transom of the ship 17 and rotatably supporting a tilt shaft 15 rotatably supporting the swivel case 14. The swivel shaft 13 has an upper end part supported by a mount rubber 18 fixed to the mount case 1 and a lower end part supported by a mount rubber 19 fixed to the extension case 2. The mounting device holds the outboard motor S on the ship 17 so as to be vertically turnable on the tilt shaft 15 and to be laterally turnable on the swivel shaft 13.

Figure 2:
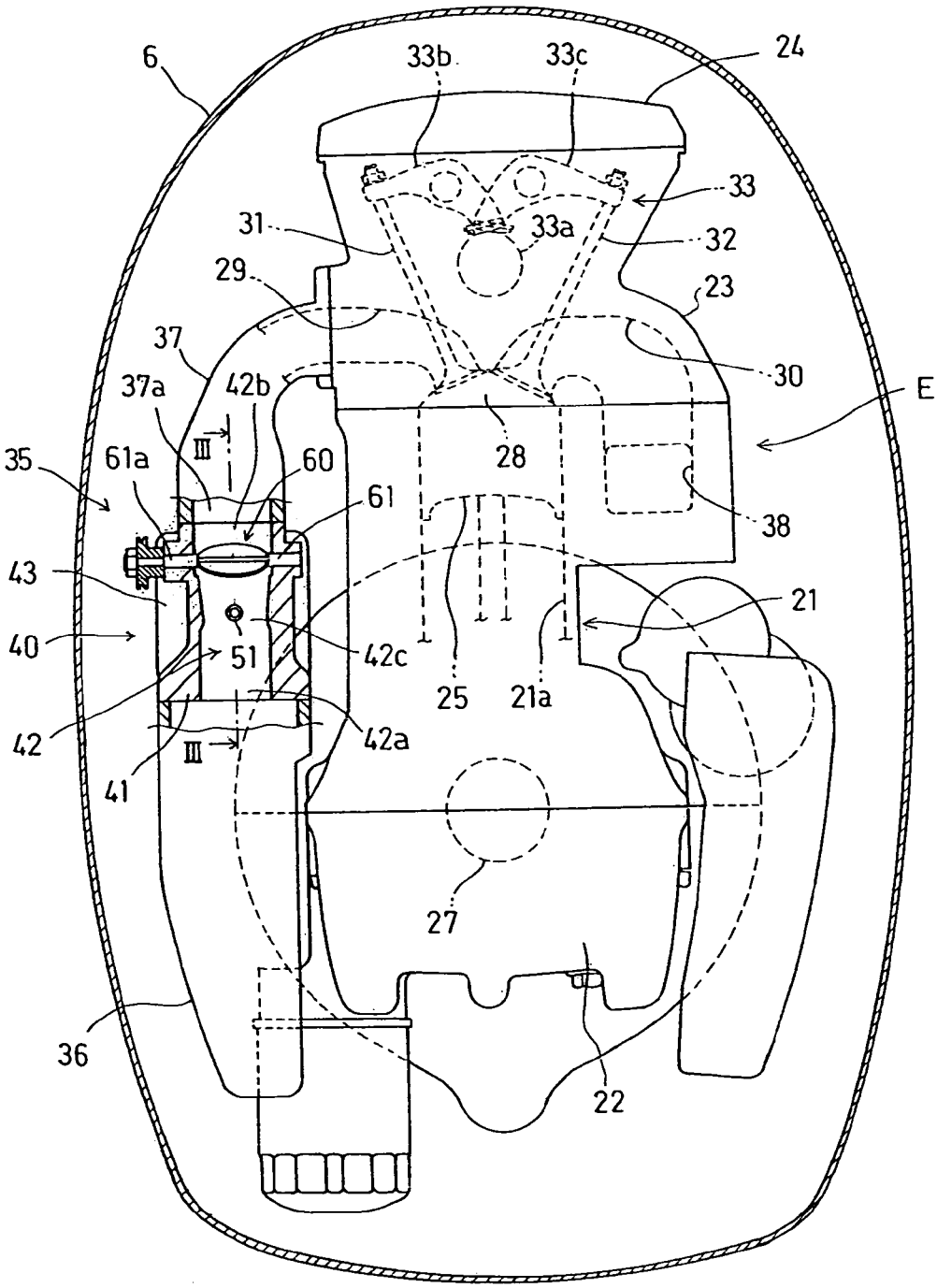
FIG. 2 is a partly sectional plan view of an essential part of the outboard motor shown in FIG. 1.

Referring to FIG. 2 as well, the internal combustion engine E, namely, a four-stroke cycle internal combustion engine, has an engine body including a cylinder block 21 provided with one or a plurality of cylinders 21*a*, four cylinders 21*a* in this embodiment, a crankcase 22 joined to the front end of the cylinder block 21, a cylinder head 23 joined to the rear end of the cylinder block 21 and a head cover 24 joined to the rear end of the cylinder head 23. The cylinder block 21 and the crankcase 22 of the engine body are fastened to the upper end of the mount case 1 with a plurality of bolts.

Pistons 25 are fitted in the cylinders 21*a* for reciprocation in the cylinders 21*a* and are connected to the crankshaft 27 by connecting rods 26, respectively. The crankshaft 27 held in a crank chamber defined by the front end of the cylinder block 21 and the crankcase 22 is supported rotatably in main bearings on the cylinder block 21 and the crankcase 22.

The cylinder head 23 is provided with combustion chambers 28 coaxial with the cylinders 21 and corresponding to the pistons 25, respectively, intake ports 29 each having a pair of intake openings opening into the combustion chamber 28, exhaust ports 30 each having an exhaust opening opening into the combustion chamber 28, and spark plugs, not shown, inserted into the combustion chambers 28, respectively.

The cylinder head 23 is provided, for each of the cylinders 21*a*, with a pair of intake valves 31 for opening and closing the intake port 29 and an exhaust valve 32 for opening and closing the exhaust port 30. The intake valves 31 and the exhaust valves 32 are driven for opening and closing motions in synchronism with the rotation of the crankshaft 27 by an overhead-camshaft type valve train disposed in a valve train chamber defined by the cylinder head 23 and the head cover 24. The valve train 33 includes a cam shaft 33*a* supported for rotation on the cylinder head 23 and driven for rotation through a transmission mechanism, not shown, by the power of the crankshaft 27, intake rocker arms 33*b* driven for a rocking motion by cam lobes formed on the cam shaft 33*a* and exhaust rocker arms 33*c* driven for a rocking motion by cam lobes formed on the cam shaft 33*a*. The intake valves 31 and the exhaust valves 32 are driven for opening and closing motions through the intake rocker arms 33*b* and the exhaust rocker arms 33*c*, respectively, by the cam lobes.

The internal combustion engine E with carburetor is provided with an intake system 35 including an intake silencer 36, carburetors 40 respectively for the cylinders 21*a* and intake pipes 37 connected to the cylinders 21*a*, respectively. The carburetor 40 mixes intake air taken through the intake silencer 36 and fuel to produce an air-fuel mixture. The air-fuel mixture metered by the throttle valve 60 of the carburetor 40 flows through the intake pipe 37 and the intake port 29 into the combustion chamber 28 when the intake valve 31 is opened. Then, the spark plug ignites the air-fuel mixture for combustion. The pressure of a combustion gas created by burning the air-fuel mixture pushes the piston 25 and the piston 25 drives the crankshaft 27 for rotation through the connecting rod 26. The combustion gas used for driving the piston 25 flows as an exhaust gas into the exhaust port 30 when the exhaust valve 32 opens. Then, the exhaust gas flows from the exhaust port 30 through an exhaust passage 38 formed in the cylinder block 21 and through a passage formed in the mount case 1, the extension case 2 and the gear case 3. Then, the exhaust gas is discharged into water through a discharge hole formed in the boss of the propeller 11.

Figure 3:
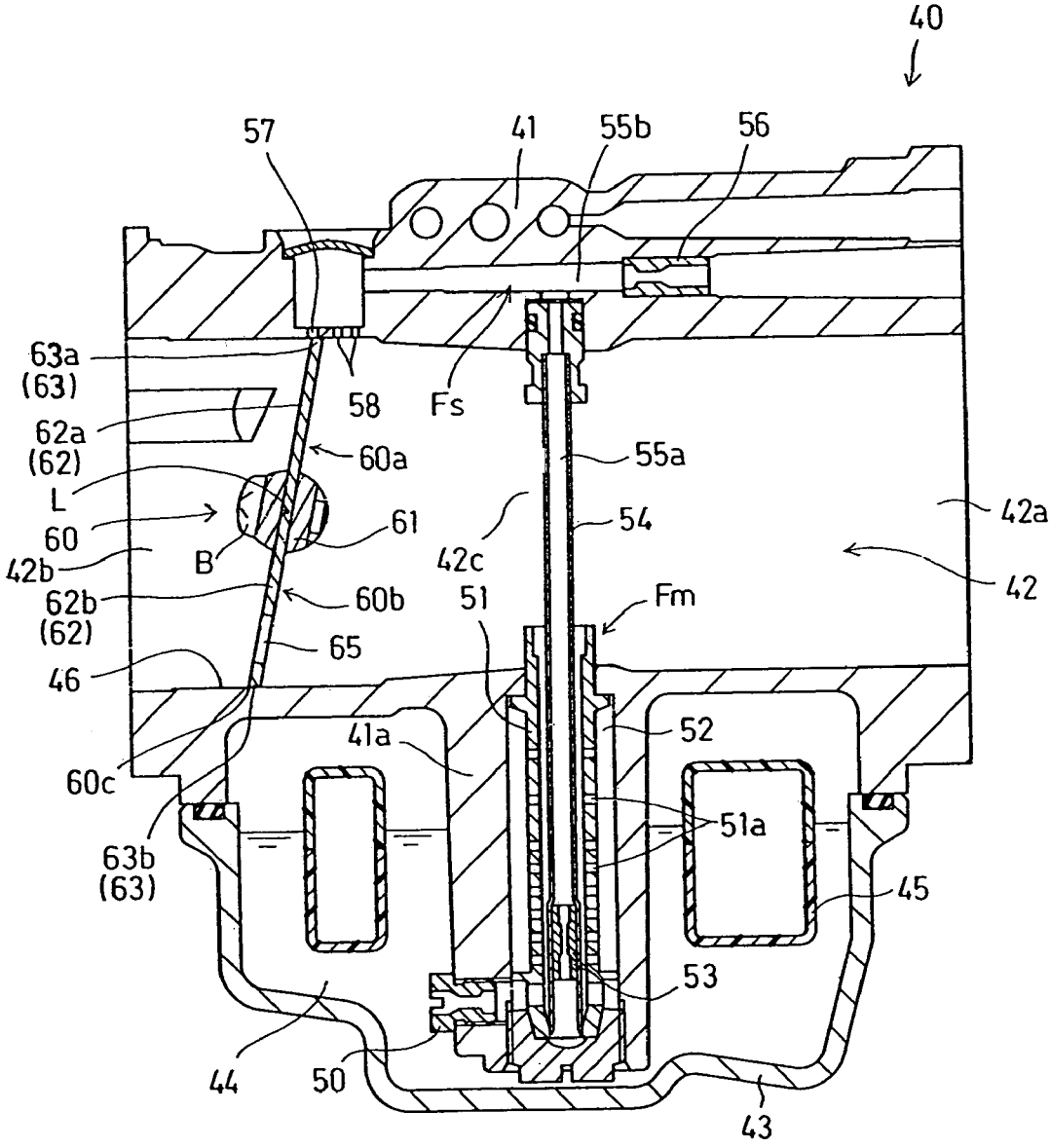
FIG. 3 is a sectional view of a carburetor taken on the line III-III in FIG. 2.

The carburetor 40 will be described with reference to FIGS. 2 and 3.

The carburetor 40 has a carburetor body 41 defining an intake passage 42 provided with a venturi 42*c*, a float bowl 43 attached to a lower part of the carburetor body 41 and defining a float chamber 44, the throttle valve 60 placed in the intake passage 42 and supported so as to be turnable in the throttle body 41, and a fuel system for supplying the fuel contained in the float chamber 44 into the intake passage 42.

Intake air or the air-fuel mixture flows through the intake passage 42. The intake passage 42 is extended substantially horizontally. The intake passage 42 has an upstream part 42*a* on the upstream side of the venturi 42*c* and a downstream part 42*b* on the downstream side of the venturi 42*c*. The upstream part 42*a* communicates with the interior of the intake silencer 36, and the downstream part 42*b* communicates with an intake passage 37*a* defined by the intake pipe 37.

The fuel system has a main fuel system $F_m$ and a slow fuel system $F_s$. The main fuel system $F_m$ withdraws the fuel contained at a fixed fuel level in the float chamber 44 by a negative pressure produced in the intake passage 42 according to the throttle angle of the throttle valve 60 and supplies the fuel into the intake passage 42.

The main fuel system $F_m$ has a main jet 50 attached to a boss 41*a* formed in the carburetor body 41 and extending through the surface of the fuel contained in the float chamber 44 and into the fuel, and a main nozzle 51 for supplying the fuel metered by the main jet 50 into the venturi 42*c*. Bleed air metered by a control valve flows into a bleed air chamber 52 formed in the boss 41*a* and surrounding the main nozzle 51. The bleed air flows into the fuel through a plurality of bleed air holes 51*a* formed in the main nozzle 51 to control the air-fuel ratio.

The slow fuel system $F_s$ has a fuel passage 55*a* formed in a fuel pipe 54 inserted into the main nozzle 51 coaxially with the main nozzle 51 and provided with a slow jet 53 for metering the fuel that flows through the main jet 50 into the fuel pipe 54, and a fuel passage 55*b* formed in an upper wall 41*b* of the carburetor body 41. The fuel that flows through the fuel pipe 54 extending across the venturi 42*c* flows into the fuel passage 55*b*. Air metered by an air jet 56 is mixed in the fuel in the fuel passage 55*b*. The fuel passage 55*b* has an idle port or ports 57 opening at a position on the downstream side of the edge of the fully closed throttle valve 60 during idling and bypass ports 58 opening at positions on the upstream side of the edge of the fully closed throttle valve 60. The fuel is supplied through the idle port or ports 57 and the bypass ports 58 into the intake passage 42 according to the throttle angle of the throttle valve 60.

Figure 4:
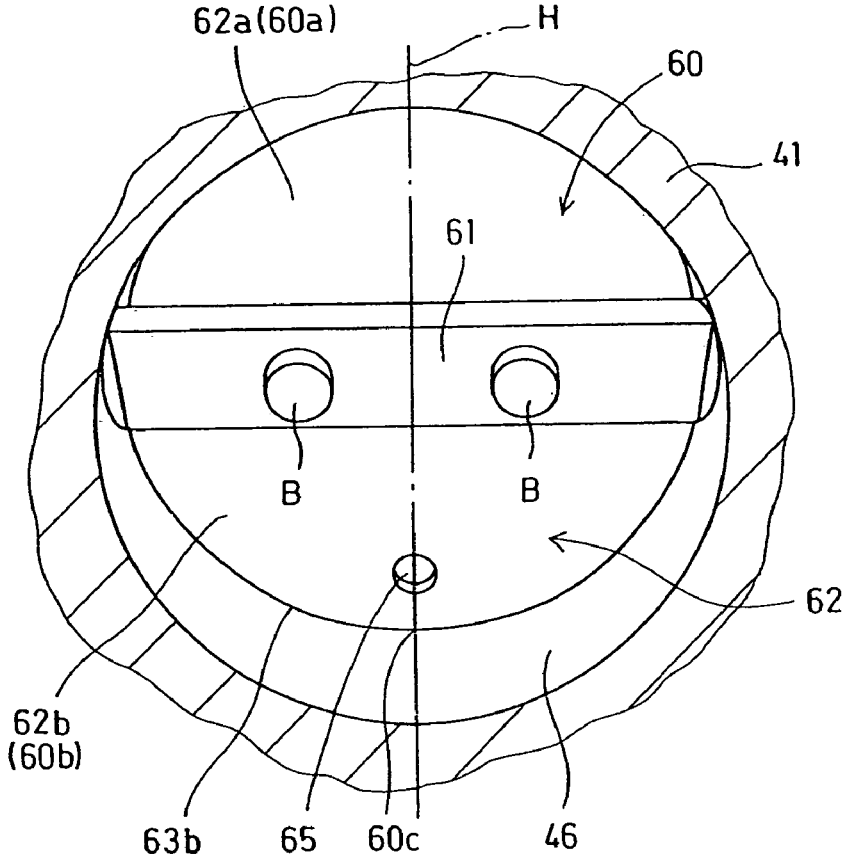
FIG. 4 is a perspective view of a throttle valve included in the carburetor shown in FIG. 3 taken from the upstream side with respect to an air intake direction.
Figure 5:
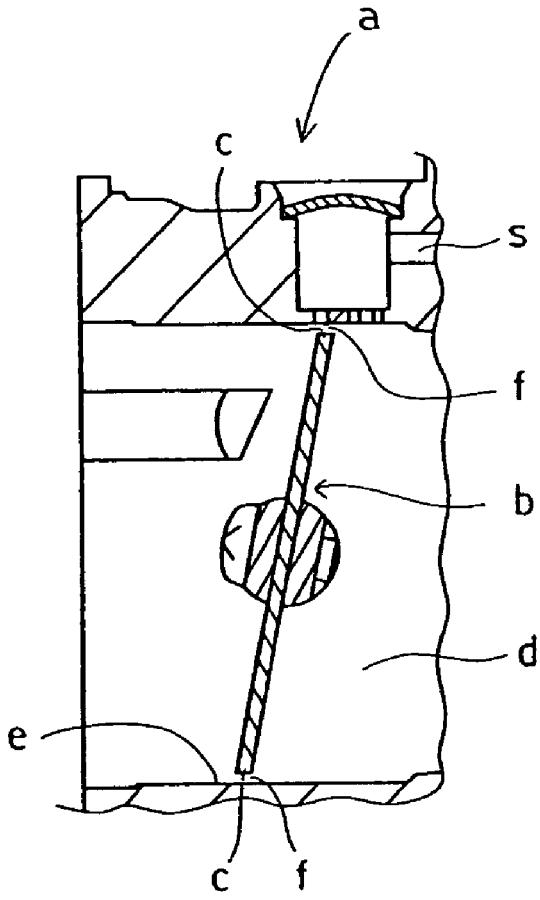
Fig.5 PRIOR ART
FIG. 5 is a sectional view of a part including a throttle valve of a known carburetor.

Referring also to FIG. 4, the throttle valve 60, namely, the butterfly valve, has a valve shaft 61 rotatably supported on the carburetor body 41 in a substantially horizontal position, and a valve plate 62 having a shape substantially resembling a circular disc and fastened to the valve shaft 61 with screws B. An operating wire, not shown, has one end connected to a throttle operating member, such as a throttle grip, and the other end connected to one end 61*a* (FIG. 2) of the valve shaft 61. The throttle angle of the throttle valve 60 is changed in a range between a minimum idle throttle angle for idling, and a maximum throttle angle to control the amount of the air-fuel mixture to be supplied into each combustion chamber 28.

When the throttle valve 60 is at an idling throttle angle and the internal combustion engine E is idling, the entire edge 63 of the throttle valve 60 is in substantially close contact with a side wall 46 defining the intake passage 42. Thus substantially no gap is formed between the edge 63 and the side wall 46 when the throttle valve 60 is at the idling throttle angle.

The throttle valve 60 is divided by a substantially horizontal valve axis L about which the throttle valve 60 turns, into a first valve part 60*a* that turns from a downstream side to an upstream side with respect to an air intake direction in the intake passage 42 when the throttle valve 60 at the idling throttle angle or fully closed position is opened and a second valve part 60*b* that turns from the upstream side to the downstream side with respect to the air intake direction when the throttle valve 60 at the idling throttle angle is opened.

A valve division 62*a* included in the first valve part 60*a* has an edge 63*a* that moves from the downstream side of the bypass ports 58 past the bypass ports 58 to the upstream side of the bypass ports 58 when the throttle valve 60 at the idling throttle angle is turned for opening. A valve division 62*b* included in the second valve part 60*b* is provided with a through hole 65 substantially resembling a round hole to make a predetermined amount of air necessary for idling flow while the throttle valve 60 is held at the idling throttle angle.

The through hole 65 is formed at a position on the throttle valve 60 adjacent to the lowest part 60*c* of the throttle valve 60 held at the idling throttle angle and on the line of intersection of the throttle valve 60 and an imaginary plane H perpendicular to the valve axis L and bisecting the throttle valve 60 with respect to a direction parallel to the valve axis L. The idle port or ports 57 and the bypass ports 58 are on the imaginary plane H. The position adjacent to the lowest part 60*c* means, for example, a position at which the shortest distance between the edge of the through hole 65 and the lowest part 60*c* of the throttle valve 60 (the edge 63*b* of the second valve part 60*b* in this embodiment) is shorter than the diameter of the through hole 65.

Intake air flows substantially only through the through hole 65 into the combustion chamber 28 and a gap is formed scarcely between the edge 63 and the side wall 46 during idling. Therefore, little intake air or a negligibly small amount of intake air as compared with the amount of intake air that flows through the hole 65, flows through the gap.

If spitting, i.e., the flow of the exhaust gas into the intake port 29 and the intake passage 27*a*, occurs in a state where the internal combustion engine E is operating for trolling or the like in an idling mode or in a very-light-load operating mode in which the throttle valve 60 is slightly opened and the exhaust gas flows through the intake port 29, the intake passage 27*a* and the intake passage 42 to the throttle valve 60, substantially all the spat back exhaust gas flows through the through hole 65 when the internal combustion engine E is operating in the idling mode and most part of the spat back exhaust gas flows through the through hole 65 while the internal combustion engine E is operating in the very-light-load operating mode. Thus the flow of the spat back exhaust gas through the gap between the edge 63 and the side wall 46 can be prevented or effectively suppressed. Consequently, even if the spat back exhaust gas contains foreign matters including lubricating oil and combustion products including carbon, the deposition of solid matters in the gap between the side wall 46 and the edge 63 of the throttle valve 60 can be prevented or effectively suppressed.

The operation and effects of this embodiment will be described.

The first valve part 60*a* of the throttle valve 60 of the carburetor 40 of the internal combustion engine E has the edge 63*a* that moves from the downstream side of the bypass ports 58 past the bypass ports 58 to the upstream side of the bypass ports 58 when the throttle valve 60 at the idling throttle angle is turned for opening. The second valve part 60*b* is provided with the through hole 65 that makes a predetermined amount of air necessary for idling flow while the throttle valve 60 is held at the idling throttle angle. Therefore, the spat back exhaust gas that has reached the throttle valve 60 flows through the through hole 65 and the foreign matters contained in the exhaust gas flow through the through hole 65. Thus the deposition of solid matters in the gap between the side wall 46 and the throttle valve 60 can be prevented or suppressed. The through hole 65 is formed in the second valve part 60*b* opposite the first valve part 60*a* of the throttle valve 60 with respect to the valve axis L of turning and is remote from the bypass ports 58. Therefore, negative pressure in the through hole 65 will not act directly on the bypass ports 58 and hence fuel discharge through the bypass ports 58 is affected scarcely by the through hole 65.

Since fuel discharge through the bypass ports 58 is affected scarcely by the through hole 65, an unstable idling operation due to the effect of the through hole 65 can be avoided and the deposition of solid matters in the gap between the side wall 46 and the throttle valve 60 can be effectively prevented or suppressed. Therefore an idle operation and a very-light-load operation can be stabilized and maintenance interval can be greatly extended.

The intake passage 42 extends substantially horizontally, and the through hole 65 is formed in a part of the throttle valve 60 adjacent to the lower end of the throttle valve 60 held at the idling throttle angle. Since the through hole 65 is formed adjacent to the lower end, around which solid matters are likely to be deposited by the agency of gravity, of the throttle valve 60, the spat back exhaust gas flowing toward the lower end of the throttle valve 60 can easily flow through the through hole 65. Since the spat back exhaust gas can easily flow through the through hole 65 formed in the part of the throttle valve 60 adjacent to the lowest part 60*c* of the throttle valve 60, the deposition of foreign matters in the gap between the side wall 46 and the throttle valve 60 can be effectively prevented or suppressed.

Modifications that may be made in the foregoing embodiment will be described.

The through hole 65 may be formed in a part of the second valve part 60*b* other than the part adjacent to the lowest part 60*c*. The valve axis L of turning of the throttle valve 60 may not be horizontal and the intake passage 42 does not need to be horizontal. The through hole 65 may be formed in any suitable shape other than a round shape. The internal combustion engine may be a three-cylinder internal combustion engine having three cylinders or may be a V-type internal combustion engine.

What is claimed is:

1. An outboard motor comprising an internal combustion engine with a carburetor having an intake passage, a butterfly-type throttle valve placed in the intake passage and a low-speed system having bypass ports and idle ports opening into the intake passage, said butterfly-type throttle valve comprising a valve plate having a first valve part that turns from a downstream side to an upstream side with respect to an air intake direction in the intake passage when the throttle valve is opened from a fully closed position, and a second valve part that turns from the upstream side to the downstream side with respect to the air intake direction when the throttle valve is opened from the fully closed position;

wherein the first valve part of the valve plate has an edge that moves from the downstream side to the upstream side past the bypass ports when the throttle valve is opened from the fully closed position, and the second valve part of the valve plate is provided with a through hole that allows air to flow therethrough at a flow rate necessary for idling when the throttle valve is at the fully closed position;

wherein the throttle valve is configured so that the through hole in the valve plate remains fully open and unobstructed in all positions of the throttle valve;

and wherein the through hole is formed in a portion of the valve plate which is spaced away from the bypass ports, whereby fuel discharge through the bypass ports is substantially unaffected by pressure adjacent the through hole during engine operation.

2. The outboard motor according to claim 1, wherein the intake passage of the carburetor extends substantially horizontally and the through hole is formed in a part of the throttle valve adjacent to a lowest part of the throttle valve at the fully closed position.

3. The outboard motor according to claim 1, wherein a valve axis about which the throttle valve turns is substantially horizontal, and the valve plate lies in a plane perpendicularly bisecting the valve axis.

4. The outboard motor according to claim 1, wherein the through hole is a round hole.

5. The outboard motor according to claim 1, wherein the bypass ports opening into the intake passage are upstream of the edge of the first valve part when the valve is closed and downstream of the edge of the first valve part when the valve is open.

6. The outboard motor according to claim 1, wherein the idle ports are downstream of the edge of the first valve part both when the valve is fully closed and fully open.

7. The outboard motor according to claim 1, wherein the throttle valve is configured such that when the throttle valve is in the fully closed position during an idling operation of said engine, intake air flows substantially only through the through hole, and little or no air flows through any gap between the throttle body and the valve plate.

8. The outboard motor according to claim 1, wherein a distance between a lower edge of the through hole and a lowest edge of the second valve part is shorter than the diameter of the through hole.

* * * * *